US007832996B2

(12) United States Patent
Eisenmann

(10) Patent No.: US 7,832,996 B2
(45) Date of Patent: Nov. 16, 2010

(54) HYDROSTATIC ROTARY CYLINDER ENGINE

(76) Inventor: Siegfried A. Eisenmann, Conchesstrasse 25, 88326 Aulendorf (DE)

( * ) Notice: Subject to any disclaimer, the term of this patent is extended or adjusted under 35 U.S.C. 154(b) by 805 days.

(21) Appl. No.: 11/658,009

(22) PCT Filed: Jul. 12, 2005

(86) PCT No.: PCT/EP2005/007543

§ 371 (c)(1),
(2), (4) Date: Jul. 2, 2007

(87) PCT Pub. No.: WO2006/010471

PCT Pub. Date: Feb. 2, 2006

(65) Prior Publication Data

US 2008/0003124 A1 Jan. 3, 2008

(30) Foreign Application Priority Data

Jul. 22, 2004 (CH) ..... 1239/04

(51) Int. Cl.
*F03C 2/00* (2006.01)
*F03C 4/00* (2006.01)
*F04C 2/00* (2006.01)

(52) U.S. Cl. ..... 418/61.3; 418/171; 475/177; 475/180

(58) Field of Classification Search ..... 418/61.3, 418/166, 171, 270; 475/177, 180, 344
See application file for complete search history.

(56) References Cited

U.S. PATENT DOCUMENTS 3,549,284 A * 12/1970 Woodling ..... 418/61.3
3,853,435 A 12/1974 Ogasahara et al.
4,666,382 A * 5/1987 Eisenmann ..... 418/61.3
5,056,994 A * 10/1991 Eisenmann et al. ..... 418/61.3
5,820,504 A * 10/1998 Geralde ..... 475/177
5,989,001 A * 11/1999 Eisenmann ..... 418/61.3

FOREIGN PATENT DOCUMENTS

EP 1 074 740 A1 2/2001

* cited by examiner

*Primary Examiner*—Theresa Trieu
(74) *Attorney, Agent, or Firm*—Muncy, Geissler, Olds & Lowe, PLLC

(57) ABSTRACT

The invention relates to a hydrostatic, slow-speed rotary cylinder engine comprising a power part (1) which acts as an output, said power part comprising a central, stationary stator (4), a rotary cylinder (6) which is used as a rotor and a shaft (2) which is mounted in a central manner on both sides of the roller bearings (10, 11) which are arranged directly adjacent to the power part (1). Supply and discharge of tooth chambers comprising the working fluid is controlled by means of a disk-shaped rotational valve (3) which is mounted in a continuously centered manner in relation to the shaft (2) and the stator (4). A toothed wheel drive is arranged between a shaft external toothing (14) and an internal toothing (17) of a stationary internal toothed ring (28; 92) as a synchronous drive for the rotational valve (3). The toothed wheel drive is subsequently arranged in the leakage oil region of the engine and is formed by a planetary gear (80) or, preferably, by an eccentric gear (30).

38 Claims, 12 Drawing Sheets

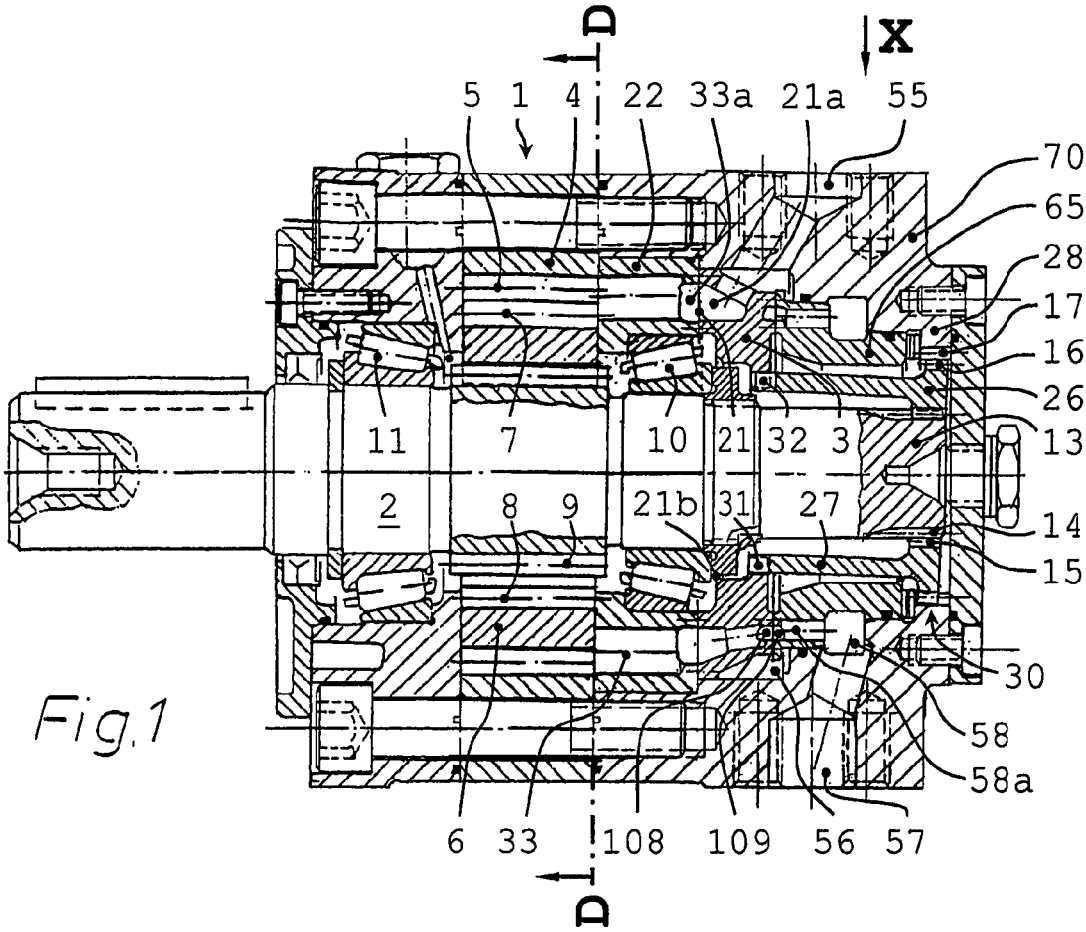
Fig.1
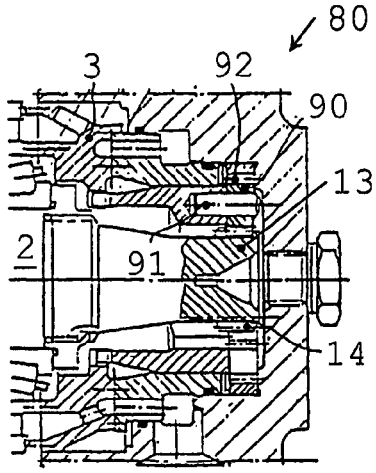
Fig.1.1
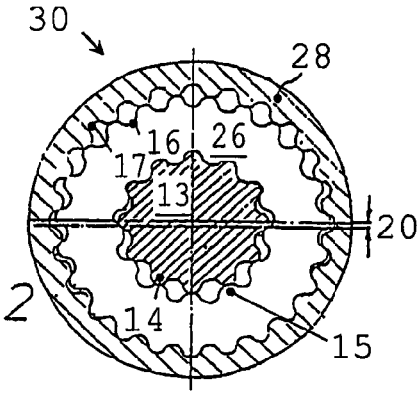
Fig.1.2

| | 1.gear | 2.gear | 3.gear |
|---|---|---|---|
| $\sum q_M$ (cm³/rev) | 200 | 120 | 80 |
| $n_M$ (rev/min) | 160 | 267 | 400 |
| ratio i | 12,5 | 7,5 | 5,o |
| jump $\varphi$ | 1,67 | 1,5 | |

77

HYDROSTATIC ROTARY CYLINDER ENGINE

This application is the national phase under 35 U.S.C. §371 of PCT International Application No. PCT/EP2005/007543, which has an International filing date of Jul. 12, 2005, and designated the United States of America, which claims priority to Swiss application No. CH 01239/04, filed on Jul. 22, 2004, each of which is incorporated herein by reference in its entirety.

FIELD OF THE INVENTION

The invention relates to a hydrostatic, low-speed rotary cylinder engine according to the preamble of independent claims 1 and 2.

BACKGROUND OF THE INVENTION

A hydrostatic rotary cylinder machine of this type is disclosed in EP 1 074 740 B1. An advantage of the formation of a rotary cylinder machine disclosed there over earlier solutions is that the roller bearings of that part of the shaft which is under high hydrostatic load are arranged directly adjacent with a small axial spacing in the stationary housing so that a very small degree of bending deformation and tooth deformation on the shaft and accordingly a very high degree of thrust and hence of torsional output are achieved. Since, owing to this bearing arrangement, there is no possibility of providing a 1:1 rotary connection between the rotary piston acting as a rotor and the rotary valve responsible for the commutation, it has been proposed to drive the rotary valve synchronously via a toothed gear from the shaft. In the known embodiment, this toothed gear is an eccentric internal gear in which the disk-like rotary valve itself acts as an eccentric member of this gear and hence executes an unavoidable orbital movement. However, comprehensive experiments have shown that this concept which initially appears striking cannot be realized in practice at high operating pressures because the necessary eccentric movement of the rotary valve relative to the stationary control panel does not permit sufficiently accurate commutation of the machine. Greatly varying torque output at the shaft, unsatisfactory volumetric efficiency and loud noises are the result since the outer part of the eccentric gear must operate in the high pressure range. Furthermore, the axial compensation of the hydraulic forces acting axially on the rotary valve by the compensating piston was not optimal owing to the eccentric movement of the rotary valve.

Since the tooth systems of the eccentric gear produce a displacement effect similar to that in the case of an internal gear pump, it is unfavorable, owing to the hydrostatic losses resulting there, if this displacement takes place in the high-pressure part of the machine.

SUMMARY OF THE INVENTION

It is the object of the invention to eliminate these deficiencies and at the same time to reduce the slightly increased friction on the rotary valve due to the orbital movement and to reduce the production costs.

This object is achieved by realizing the characterizing features of the independent claims. Features which further develop the invention in an alternative or advantageous manner are described in the dependent patent claims.

The invention eliminates these disadvantages while retaining the abovementioned advantages of such machines.

The hydrostatic, low-speed rotary cylinder engine according to the invention comprises a power part acting as an output and having a central, stationary stator, a rotary piston as a rotor and a centrally mounted shaft. The stator has an inert tooth system with a number d of teeth. The rotary piston has an outer toothed system partly engaging the inner tooth system of the stator and having a number c of teeth and an inner tooth system having a number b of teeth. The shaft, by means of its outer tooth system having a number a of teeth, intermeshes partly with the inner tooth system of the rotary piston, the rotary piston being arranged and dimensioned eccentrically for executing an orbital movement, in such a way that tooth chambers which can be supplied with working fluid and from which working fluid can be discharged form between the inner tooth system of the stator and the outer tooth system of the rotary piston. An inlet and outlet part serves for supplying the power part with the working fluid and discharging the said fluid from said part. By means of a disk-like rotary valve which, according to the invention, is mounted so as to run concentrically with the shaft and with the stator, the supply of working fluid to and discharge of said fluid from the tooth chambers are controlled. In addition, the rotary cylinder engine comprises a toothed gear which is arranged between an outer shaft tooth system of the shaft—in particular in the form of a sun gear—having an number w of teeth and an internal tooth system of a stationary internal gear ring having a number z of teeth, as a synchronous drive for the rotary valve. The shaft is mounted by means of roller bearings arranged directly adjacent on both sides of the power part. According to the invention, the toothed gear is arranged exclusively in the leakage oil region of the engine and is formed by a planetary gear having at least one planet carrier which is non-rotatably connected to the rotary valve and on which planet wheels are arranged between the outer shaft tooth system and the stationary inner toothed ring, or preferably by an eccentric gear having an eccentric which is non-rotatably connected to the rotary valve.

Since, in the hydrostatic, low-speed rotary cylinder engine according to the invention, a continuous shaft having large shaft diameters and high torsional strength can be used, it is possible to subject both shaft ends to a high torque flow and, for example, to use both shaft ends as an output or one shaft end as an output and the other shaft end for connecting a brake or a second drive, with the result that the entire drive unit can be designed to be considerably more compact.

Owing to the omission of the orbital movement of the rotary valve, which is permitted by the invention, by housing the eccentric gear in the leakage oil space of the engine and by using economical extruded or sintered parts as gear members, an optimum, compact and economical construction thus results. Driving of the rotary valve 1:1 relative to the rotary piston of the power part via a tumbling cardan-type shaft is known from the earlier constructions. There, however, the tumbling shaft must compensate the full eccentricity of the rotary piston in the power part, resulting in a very large tumbling angle. The tumbling gear according to the invention requires a substantially smaller eccentricity which, according to the invention, is independent of the eccentricity of the rotary piston in the power part so that this tumbling angle is substantially smaller than half of that tumbling angle of the earlier construction. Thus, the tooth plays of the gear which are due to the tumbling and are necessarily increased can be dramatically reduced. The rattling noises resulting there and the wear are substantially less in the case of the construction according to the invention.

With the use of an eccentric gear, the eccentric which in particular is disk-like is non-rotatably connected via a pot-like connecting part to the rotary valve via driver tooth systems in the speed ratio 1:1. The eccentric has, for example, an inner tooth system with a number x of teeth and an outer tooth system with a number y of teeth and is arranged between the outer shaft tooth system and the inner tooth system of the stationary inner toothed ring so that the corresponding inner and outer tooth systems intermesh with one another in a known manner.

The following equation represents the speed ratio of shaft to rotary piston or shaft to rotary valve:

$$\frac{\frac{b}{a}\cdot d - c}{d - c} = \frac{\frac{x}{w}\cdot z - y}{z - y}$$

As can readily be seen from this equation, the number of teeth of the eccentric gear is entirely different.

A first option would have been, for example, the design exactly as in the case of the power part with w=12, x=14, y=11 and z=12. It need only be noted that the eccentricities of the two inner gears are exactly identical. The result of the equation is a positive integer, preferably equal to 3. Furthermore, it must be ensured that, in this range, the diameter of the shaft is sufficiently large so that its torsional strength is still sufficient for the maximum torque for any connected holding brake. Here, however, the eccentricity of the gear is relatively large so that the tumbling angle is correspondingly large. However, the revolutions per minute of the eccentricity would then be rather low.

The ratio of the revolutions per minute Ne of the eccentricity of the eccentric gear to the revolutions per minute Nw of the shaft is obtained from the equation $$\frac{Ne}{Nw} = -\frac{w\cdot y}{x\cdot z - w\cdot y}$$

where this ratio is preferably from −3 to −9.

A second option comprises the preferred designs of the number of teeth according to a=12, b=14, c=11, w=12, x=13, y=23 and z=24 or according to a=12, b=14, c=11, d=12, w=9, x=10, y=17 and z=18, with in each case a very small eccentricity. As can easily be seen from the above equation Ne/Nw, the revolutions per minute of the eccentricity are then higher but still remain below the value of the tumbling shaft of earlier known constructions.

In designing the eccentric gear with the numbers a=12, b=14, c=11, d=12, w=12, x=13, y=23 and z=24 of teeth, there are the following advantages: since, when assembling the engine, the rotary position of the rotary valve must always exactly match the rotary position of the engine in the power part in the phase position, it is expedient if the number w of teeth and the rotary position thereof on the shaft are exactly identical to the number of teeth a of the outer toothed system on the shaft at the power part and the rotary position thereof. Thus, the shaft can always be mounted without it being necessary to pay attention to the rotary position in which it is present, with the result that assembly is considerably simplified.

The proposed numbers a=12, b=14, c=11, d=12, w=9, x=10, y=17 and z=18 of teeth have, with regard to the tooth system for the eccentric gear, the advantage that the toothing modulus is greater, the stability of the shaft in this region increases and in particular the negative speed of the eccentric axle of the eccentric disk decreases sharply, which leads to quieter running of the gear. It is accepted thereby that the tumbling angle will be somewhat greater, and the advantage described above during assembly is also dispensed with.

Experiments have shown that very good results are obtained if the common eccentricity of the eccentric gear is from 0.013 to 0.015 times or from 0.015 to 0.022 times the mean reference circle diameter of the control ports in the control panel.

Since, in the case of the conventional machines having a cardan shaft between the rotary piston and the output shaft (of which about 1.2 million units are currently produced worldwide), the large hydrostatic radial force on the rotary piston has to be completely absorbed by the teeth between the rotary piston acting as a rotor and the stator, the Hertz pressure and hence the friction between these teeth are very great since it is known that the cardan shaft cannot absorb radial forces. Particularly in the case of low speed and high operating pressure, the frictional losses and the wear of the teeth are therefore extremely great. The start-up efficiency of these machines is therefore correspondingly poor and is only about 63 to 71%.

For high operating pressures—in particular above 120 bar—it is therefore indispensable, in the case of these earlier constructions having a cardan shaft as a torque connection between the rotary piston and the output shaft, for the teeth of the inner tooth system on the stator to be formed by rollers which are rotatably mounted in their exactly processed caverns in the stator by a variable hydrodynamic oil film. The rollers must be designed with great hardness and the best surface quality, as must the precise caverns in the stator which are necessary therefor.

In the machine according to the invention, the radial load on the teeth between rotary piston and stator is only a fraction of the conditions described above, so that the thrust of the motor can be considerably increased even without rollers in the stator. Nevertheless, it is advantageous even in the case of the machine according to the invention if the customary rollers in the stator are retained, which leads to further increased thrust and excellent service life. Measurements have shown that, in the case of the machine according to the invention, the start-up efficiency and also the mechanical-hydraulic efficiency can be increased by 3 to 5% where the transition to rollers in the stator. Here, the start-up efficiency reaches values of more than 90%.

With the use of the hydrostatic, low-speed, high-torque engine according to the invention as a wheel engine, the roller bearing on the output side requires a higher radial load rating for additional absorption of the axle load. It should be arranged as close as possible to the center of the wheel. Since, for example in the case of floor conveyers, abrupt excessive increase of the static axle load can occur, it is advantageous if this bearing is located as close as possible to the wheel flange and optionally outside the leakage space of the rotary cylinder engine with a permanent roller bearing grease fill directly in the housing part of the rotary cylinder engine.

Owing to the advantageous bearing arrangement and the efficient continuous shaft, the rotary cylinder engine according to the invention is outstandingly suitable, inter alia, as a wheel engine or winch drive for directly driving a wheel or a cable drum. In this case, the shaft is preferably formed integrally with a wheel flange on which a wheel or a cable drum for direct drive is directly mountable.

The device according to the invention is described in more detail below purely by way of example with reference to specific working examples shown schematically in the figures, further advantages of the invention also being discussed.

Specifically:

BRIEF DESCRIPTION OF THE DRAWINGS

FIG. 1 shows a first working example of a rotary cylinder engine having an eccentric gear in a longitudinal section along the section line C-C of FIG. 2, FIG. 1.1 shows a second working example of a rotary cylinder engine having a planetary gear in a partial longitudinal section along the section line C-C of FIG. 2, FIG. 1.2 shows a cross-section through the eccentric gear of the first working example of the rotary cylinder engine.

DETAILED DESCRIPTION

Figure 2:
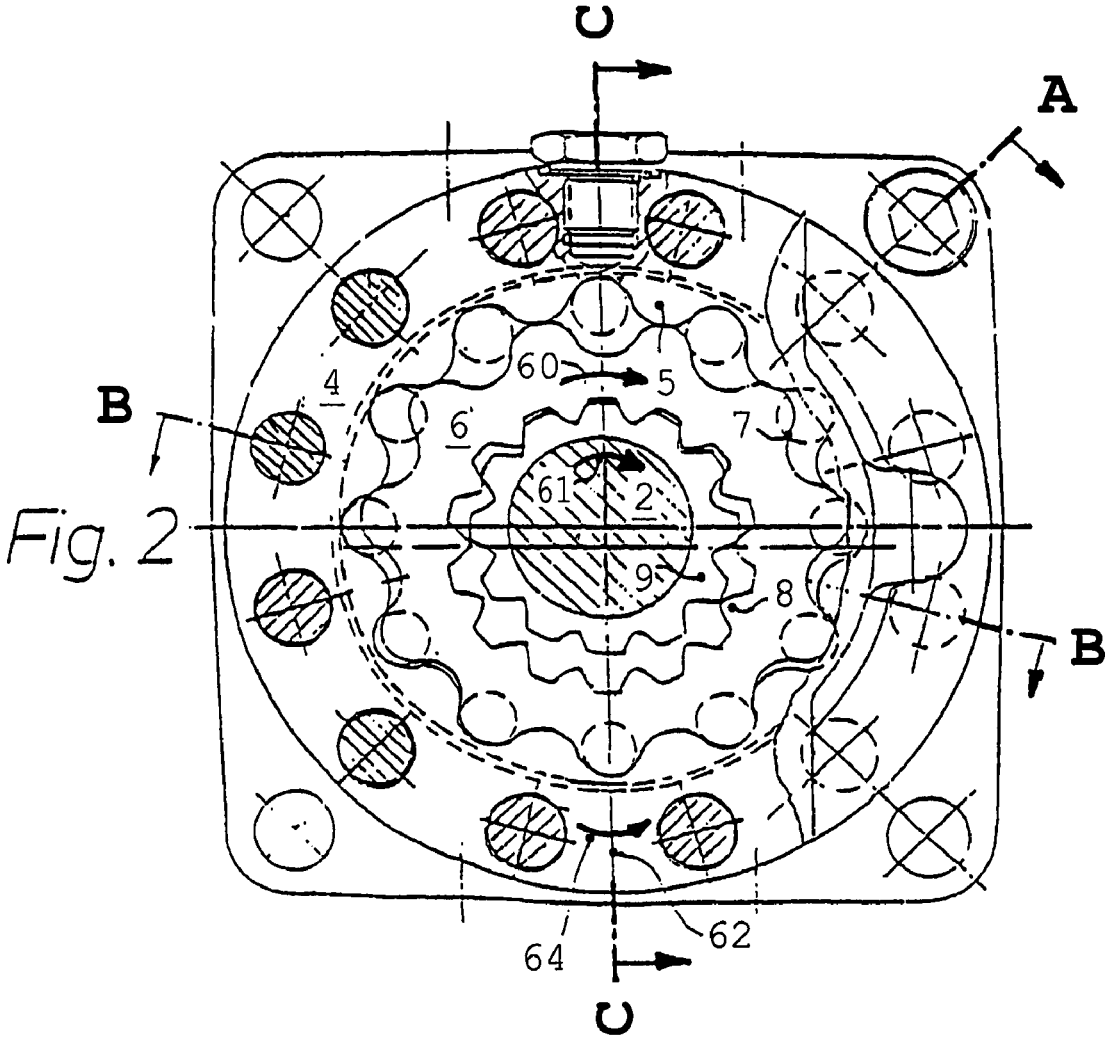
FIG. 2 shows a cross-section along the section line D-D of FIG. 1 through the rotor-stator system of the first working example.

Below, possible working examples are explained with reference to several figures, some of which show a single embodiment in different views with different degrees of detail, reference being made in some cases to reference numerals already mentioned in preceding figures.

FIG. 1 shows a first working example of a rotary cylinder engine according to the invention having an eccentric gear in a longitudinal section, while FIG. 2 shows a cross-section through the rotor-stator system of the first working example along the section line D-D of FIG. 1. Furthermore, FIG. 2 shows the section direction of FIG. 1 from the section line C-C. The rotor-stator system of the power part 1 of the rotary cylinder engine comprises a central, stationary stator 4 having an inner tooth system 5, referred to below as first inner toothed system 5, which is engaged at least partly by a rotary piston 6 which is arranged eccentrically for executing an orbital movement, acts as a rotor and has an outer tooth system mentioned below as first outer toothed system 7. A shaft 2 mounted centrally between two roller bearings 10, 11 arranged directly adjacent on both sides of the power part 1 has an outer tooth system 9—the second outer tooth system 9—which in turn at least partly engages an inner tooth system 8 of the rotary piston 6, referred to as the second inner tooth system 8. Let the forward direction of rotation of the rotor-stator system of the rotary cylinder engine be defined, for the following explanations, as that direction of rotation in which the rotary piston 6 rotates in the direction of rotation 60 and the shaft 2 rotates in the direction of rotation 61 according to FIG. 2. Accordingly, in FIG. 2, the expanding absorption cells between the first inner tooth system 5 and the first outer tooth system 7 are always on the left and the compressing transport cells always on the right of eccentric axis 62. Since the eccentric axis 62 has a direction of rotation 64 which is opposite to the direction of rotation 61 of the shaft 2 and the direction of rotation 60 of the rotary piston 6, the result is a rotational field for the radial hydraulic force on the rotary piston 6 if high pressure is always fed to the expanding absorption cells. The control of this rotational field is provided by a rotary valve 3 as a commutator, similarly to a DC motor. To initiate a forward rotation, a fluid—in particular hydraulic oil as working fluid—is fed to a high-pressure connection 55 in an inlet and outlet part 70 and hence to a first annular space 56 which surrounds the rotary valve 3 with a seal. According to the number of teeth of the first inner tooth system 5 of the stator 4 and of the first outer tooth system 7 of the rotary piston 6 in the first working example, the rotary valve 3 has eleven high-pressure windows 21*a* distributed uniformly on the circumference and connected to the first annular space 56.

A control panel 22 having control ports 21 has twelve pressure windows 33*a* which are uniformly distributed on the circumference and are connected via feed bores 33 to the twelve tooth chambers between the first inner tooth system 5 of the stator 4. Owing to the circumferential distribution of eleven to twelve of the high-pressure windows 21*a* of the rotary valve 3 and of the pressure windows 33*a* of the control panel 22, only half the tooth chambers in the stator 4 are ever under high pressure, and, in particular in the case of a correct phase position of the rotary valve 3 with the rotary piston 6, always those tooth chambers which are to the left of the eccentric axis 62 in FIG. 2. Since the rotary valve 3 has low-pressure windows 21*b* uniformly distributed between the high-pressure windows 21*a* and of the identical form, the other half of the twelve tooth chambers of the stator 4 are connected via connecting bores 58*a* to a second annular space 58 having annular grooves 108 and 109 and hence to a low-pressure connection 57, so that the compressing transport cells displace the fluid under low pressure into the low-pressure side and hence into the low-pressure connection 57.

It should therefore be ensured that the axis which separates the rotary valve 3 into a high-pressure side and a low-pressure side executes as far as possible exactly the same revolutions per minute and in the same direction of rotation as the rotor-stator system. This precondition is the case if the rotary valve has the same direction of rotation and the same revolutions per minute as the rotary piston 6 about its own axis. In the case of the rotary cylinder engine according to the invention, in a preferred embodiment, the shaft 2 is mounted on roller bearings immediately to the left and right of the rotor-stator system in the housing so that the rotary valve 3 must be driven via the shaft 2 which, by virtue of the system, executes a different number of revolutions per minute from the rotary piston 6. In the working example shown, the shaft 2 runs three times as fast about its axis as the rotary piston 6 about its own axis. Accordingly, the rotary cylinder engine according to the invention requires a gear between the shaft 2 and the rotary valve 3 with the same transmission to slow speed. This can be effected by means of an eccentric gear 30, as in the first working example according to FIG. 1 and FIG. 1.2, or by means of a planetary gear 80, as shown in a second working example according to FIG. 1.1.

FIG. 1.1 shows the second working example of a rotary cylinder engine according to the invention, having a planetary gear 80, in a partial longitudinal section along the section line C-C of FIG. 2. The planetary gear 80 comprises a sun wheel 13 on the shaft 2, the outer shaft tooth system 14 of which intermeshes with planet wheels 90 which are mounted on a planet carrier 91 which is non-rotatably coupled 1:1 to the rotary valve 3. The planet wheels 90 simultaneously intermesh with a stationary inner toothed ring 92 which has twice the number of teeth as the sun wheel 13 on the shaft 2. According to the laws of planetary gears, the transmission from the shaft 2 to the rotary valve 3 is exactly 3:1 to slow speed.

However, as shown in the first working example in FIG. 1 and FIG. 1.2, it is preferable to use an eccentric gear 30 which is of simple design and comprises a sun wheel 13 on the shaft 2 having an outer shaft toothed system 14 and a stationary inner toothed ring 28, the inner tooth system 17 of which, referred to below as fourth inner tooth system 17, has twice as many teeth as the number of teeth of the outer shaft tooth system 14. Inserted in between is the disk-like eccentric 26 which has an inner tooth system 15—the third inner tooth system 15—in the interior and an outer tooth system 16, referred to as the third outer tooth system 16, on the outside. This eccentric gear 30 is preferably designed with tooth shapes which make it possible for the difference in the number of teeth between the outer shaft tooth system 14 and the third inner tooth system 15 and the third outer tooth system 16 and the fourth inner tooth system 17 to be equal to 1. With involute teeth, such gears cannot as a rule be realized since in this case there are tooth head engagement problems. Furthermore, under these conditions, they do not permit exact radial centering of the wheels relative to one another. Other tooth shapes should therefore be relied upon.

In the example of FIG. 1.2, a double cycloid inner-outer tooth system is preferably used as disclosed, for example, in German patent DE 39 38 346, which is hereby incorporated by reference.

This eccentric gear 30 likewise has a transmission between the shaft 2 and a disk-like eccentric 26 of exactly 3:1 to slow speed. As can be seen from FIG. 1, the disk-like eccentric 26 is rotatably connected 1:1 rigidly via a pot-like connecting part 27 to the rotary valve 3, driver tooth systems 31 and 32 enabling the pot-like connecting part 27 together with the disk-like eccentric 26 to execute a small tumbling movement corresponding to the eccentric movement of the disk-like eccentric 26. The tooth plays of the outer shaft tooth system 14, of the third inner tooth system 15 of the eccentric 26, of the third outer tooth system 16 of the eccentric 26, of the fourth inner tooth system 17 of the inner toothed ring 28 and the driver tooth systems 31 and 32 should be made slightly larger than usual owing to the tumbling movement.

To ensure that the rotary valve 3 is rotationally movable but is thoroughly sealed axially to prevent leakage from the high pressure, an axial compensating piston 65 is provided in a known manner.

Figure 3:
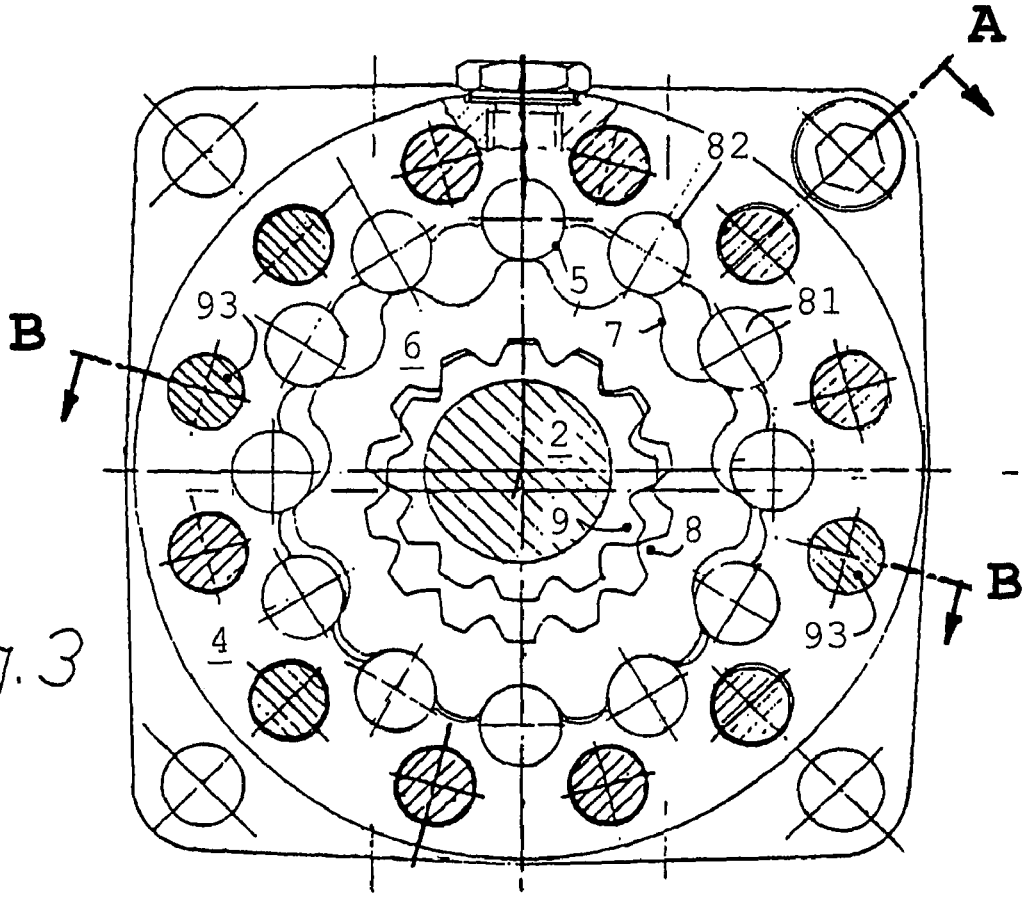
FIG. 3 shows a cross-section through the rotor-stator system of a working example having rotatably mounted rollers as an inner toothed system in the stator.

FIG. 3 shows a cross-section through the rotor-stator system of a further working example in which rotatably mounted rollers 81 are used as first inner toothed system 5 in the stator 4. These rollers 81 should always be trapped in their caverns 82 in the stator 4, i.e. the caverns 82 should taper in the direction of the shaft 2 beyond the roller radius, so that the rollers 81 cannot move radially inwards out of the caverns 82. This would lead to blockage of the rotary cylinder engine. In FIG. 3, the shape of the caverns 82 is clearly illustrated.

As can be seen from FIGS. 2 and 3, in a compact construction of the rotary cylinder engine according to the invention having an appropriately small reference circle diameter of the screws, the first inner toothed system 5 of the stator 4 must be offset by half a tooth division on changing to rollers 81 as teeth in the stator 4, as shown in FIG. 3. This means that the feed bores 33 and the associated pressure windows 33*a* and control ports 21 on a reference circle in the control panel 22 are correspondingly offset. It is therefore advantageous if the number of teeth of the driver tooth systems 31, 32 is twice as great as the number c of teeth of the first outer tooth system 7 of the rotary piston 6 of the power part 1. In this design of the number of teeth of the driver tooth systems 31, 32, the rotary valve 3 and the control panel 22 can then be used without modification in all cases. In the case of the preferred design having the numbers a=12, b=14, c=11, d=12, w=12, x=13, y=23 and z=24 or a=12, b=14, c=11, d=12, w=9, x=10, y=17 and z=18 of teeth, the number of teeth of the driver tooth systems 31, 32 would then have to be chosen as 22.

Figure 4:
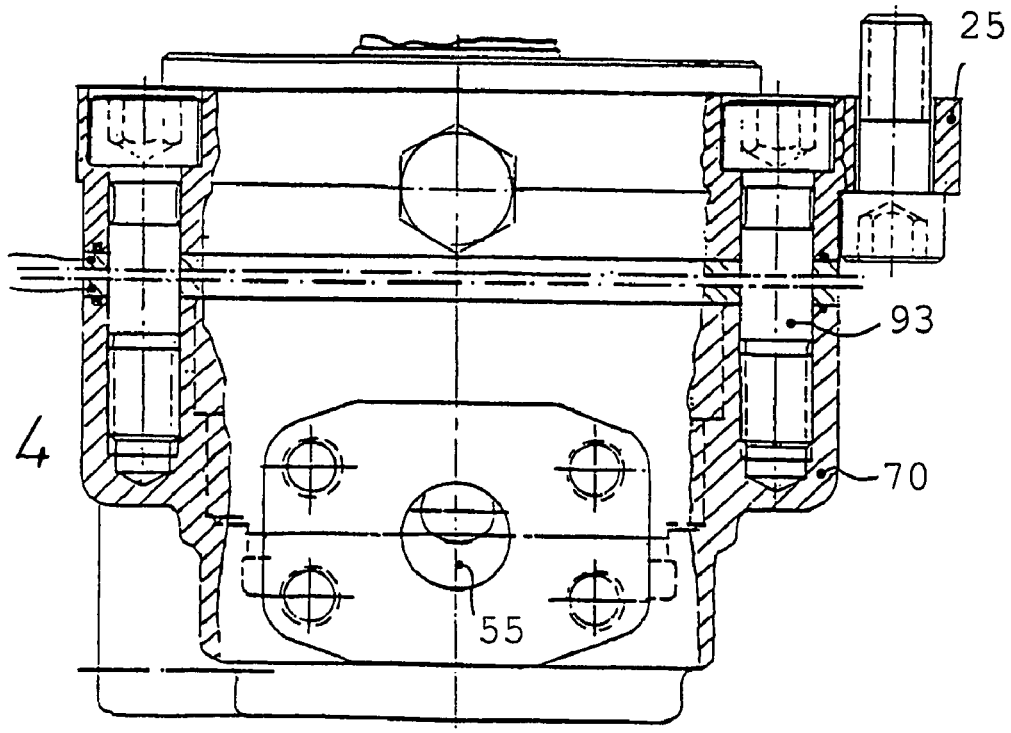
FIG. 4 shows a view X of FIG. 1 onto an SAE connection of a working example, a partial section along the line A and a partial section along the line B of FIG. 3.

The housing parts which comprise a bearing flange 25, the stator 4 and the inlet and outlet part 70 must be centered relative to one another during assembly. In FIG. 3 and in FIG. 4, which show a view X of an SAE connection, a partial section along the line A and a partial section along the line B of FIG. 3, it is also shown that two of the twelve screws altogether are in the form of set screws which are to be inserted first during assembly of the engine. From FIG. 4, it is likewise evident in the partial section A of FIG. 3 that the rotary cylinder engine should be constructed in a very compact manner on the basis of the hole patterns specified by the international SAE standard for fixing the engine, so that dimensions and weight are optimized. A flange screw union for the high-pressure and low-pressure connections 55 and 57, respectively, according to SAE standard, is also shown here.

Figure 5:
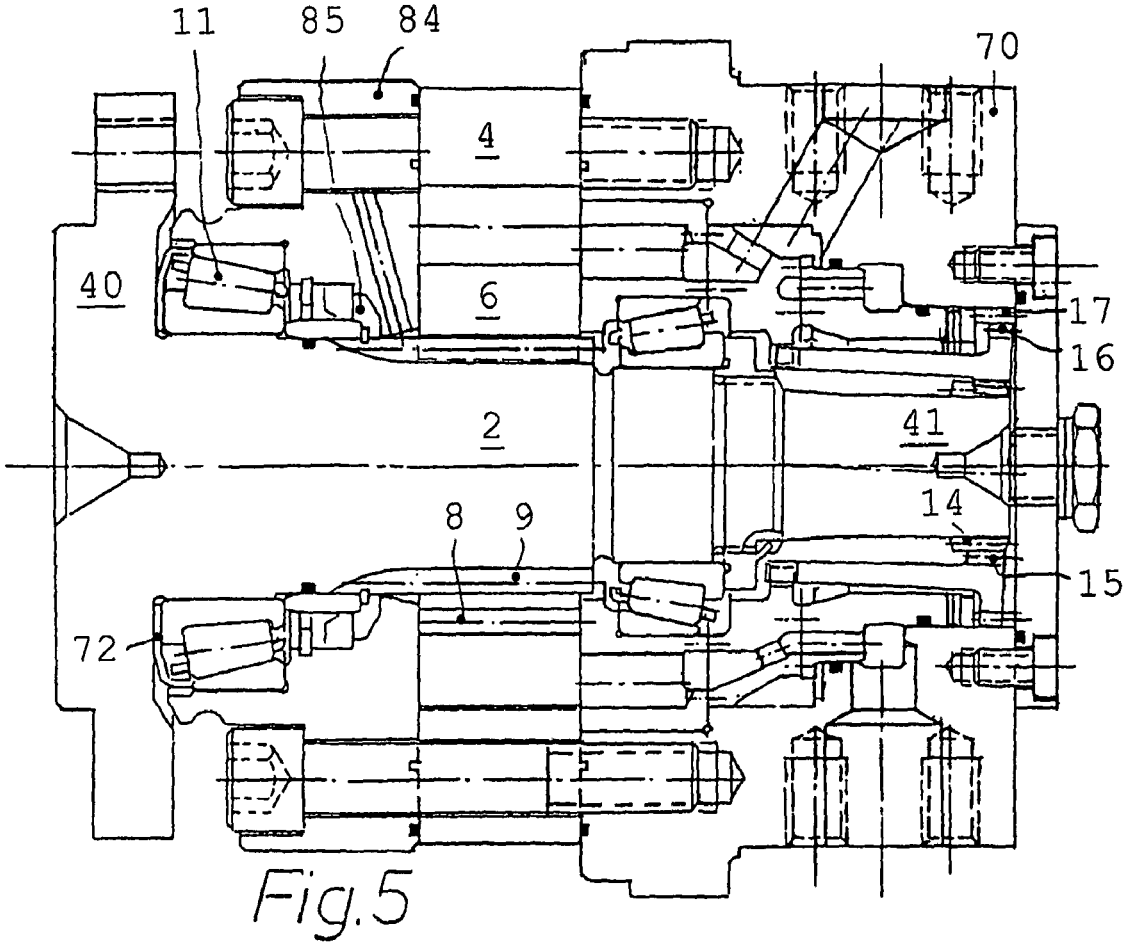
FIG. 5 shows a longitudinal section through a working example of a wheel engine according to the invention.

One application for the rotary cylinder engine according to the invention is the use as a wheel engine, as shown in its simplest form as a longitudinal section in FIG. 5. Extremely advantageous in this working example of a wheel engine is the formation of a roller bearing 11 on the output side outside a leakage space 85 directly in the housing part 84 of the engine. Since such wheel engines do not require high speeds, a permanent roller bearing grease fill is sufficient as lubrication and is sealed from the outside by an NILOS ring 72. By means of this construction, it is possible for a wheel flange 40 to be formed integrally with the shaft 2 so that the shaft can be formed to be very strong for high axle loads.

In the case of a wheel engine according to FIG. 5, at least one clockwise and one counterclockwise version is required. Here too, it is advantageous if the rotary valve can be offset by a half a division during assembly so that, with the same pressure connection and hence with the same flow direction of the working fluid, the direction of rotation of the engine is herewith reversible for identical physical operating conditions.

Figure 6:
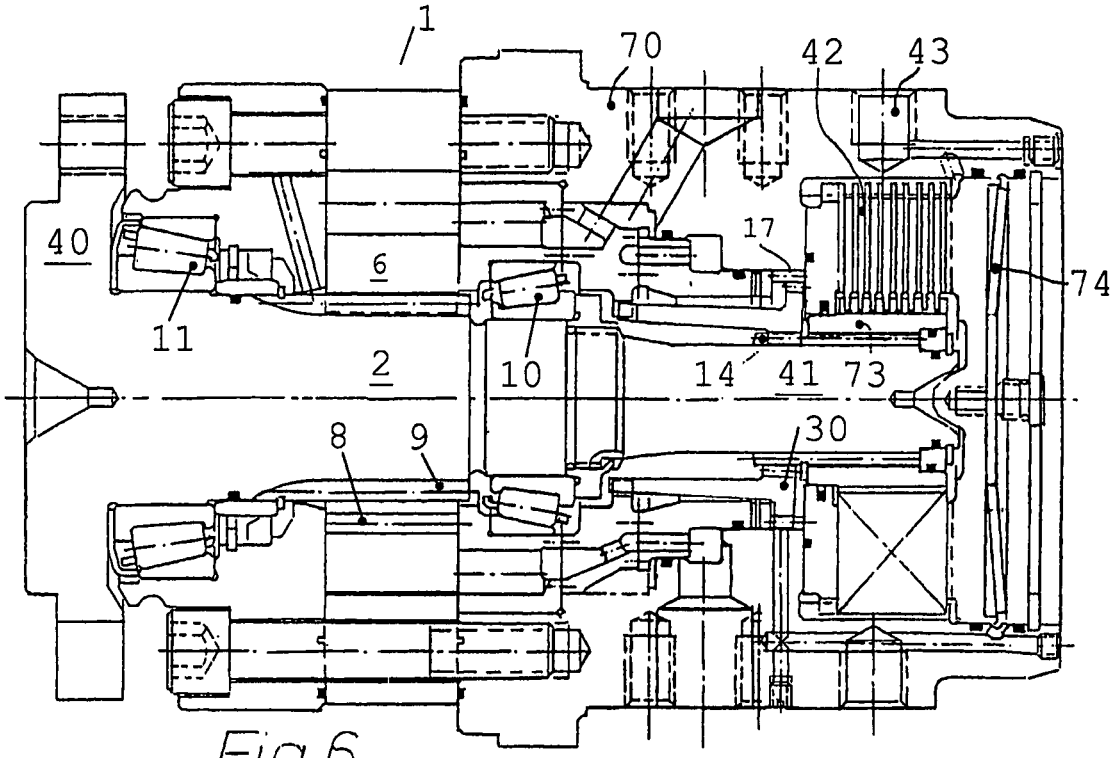
FIG. 6 shows a longitudinal section through a wheel engine according to the invention having a parking brake coupled to the shaft and in the form of a multiple disk brake.

A hydrostatic wheel bearing generally requires an automatic parking brake which is independent of the hydraulic pressure and as far as possible spring-loaded in order to prevent a parked vehicle from rolling away. FIG. 6 shows a possible realization of such a wheel engine in longitudinal section, in which a spring-loaded parking brake 42 in the form of a multiple disk brake is arranged on the side opposite the output. The rotary cylinder engine according to the invention advantageously permits a continuous shaft 2 suitable for high torques and having a large-dimension shaft extension 41 so that the disks of the parking brake 42 can transmit their braking moment to the shaft 2 directly via a hub 73. Here, in a manner advantageous in terms of manufacturing technology, the outer shaft tooth system 14 is lengthened outwards for the eccentric gear 30 on which the hub 73 can be non-rotatably fastened by means of wedges in a manner effective with respect to torque. This spring-loaded parking brake 42 is a wet-running multiple disk brake which can be released with greatly reduced hydraulic pressure via the separate connection 43. A plate spring 74 is provided as a spring here. As can be seen from FIGS. 5 and 6, the stationary fourth inner tooth system 17 for the eccentric gear 30 is incorporated directly into the inlet and outlet part 70, for example by means of a gear shaping machine or by means of a broaching tool. This results in the advantage that the outer shaft tooth system 14 on the shaft 2 is larger in diameter so that the shaft extension 41 acquires a greater torque capacity. Particularly in the case of broad running wheels in the power part 1, this is of particular importance, as explained further below. Since, with the broadening of the running wheel of the power part 1, the torque-transmitting second inner tooth system 8 of the rotary piston 6 and the second outer tooth system 9 of the shaft 2 are also automatically broadened, the high-pressure level can be very substantially maintained here and hence an increase in power can be achieved. In the case of the machines with cardan shaft output between the rotor and the output shaft, this is not possible. In the case of broader running wheels with the stator 4 and the rotary piston 6, only a lower pressure level is therefore permitted there. Engines having broader running wheels also generally run more slowly owing to the larger amount absorbed, so that the service life of the roller bearings 10 and 11 does not present any great problem.

Figure 7:
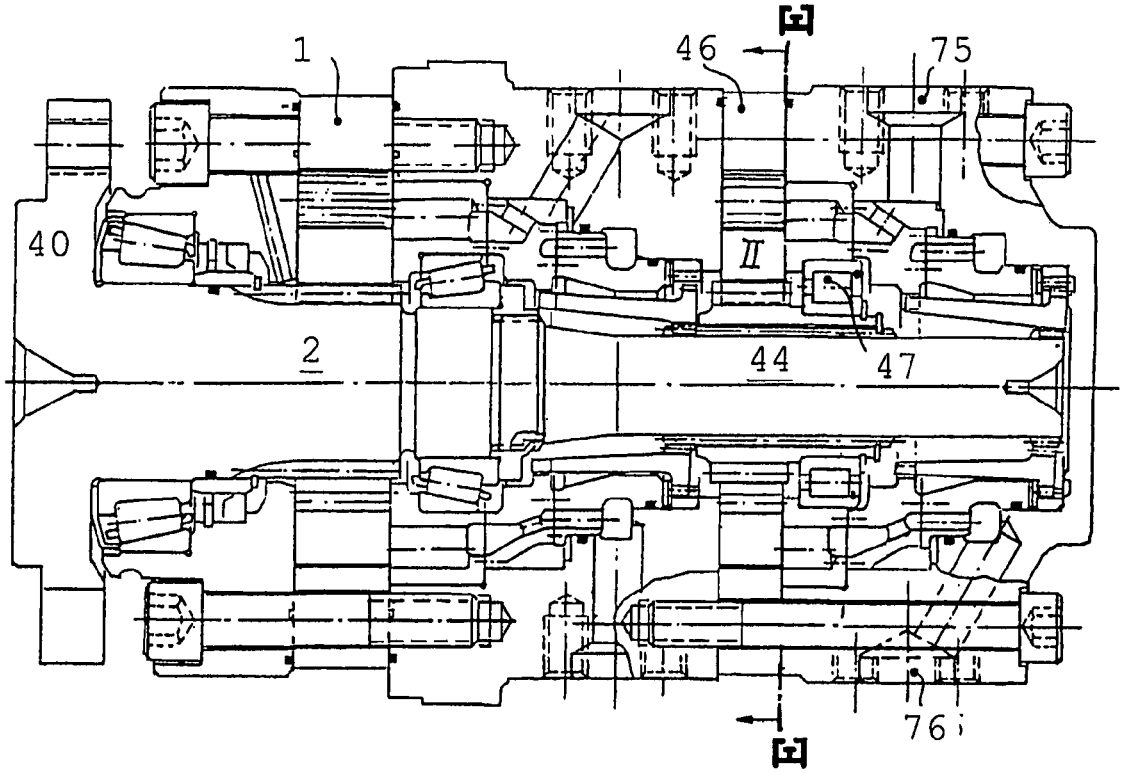
FIG. 7 shows a longitudinal section through a wheel engine according to the invention having a second engine coupled to the shaft and in the form of a ⅔-stage engine.
Figure 8:
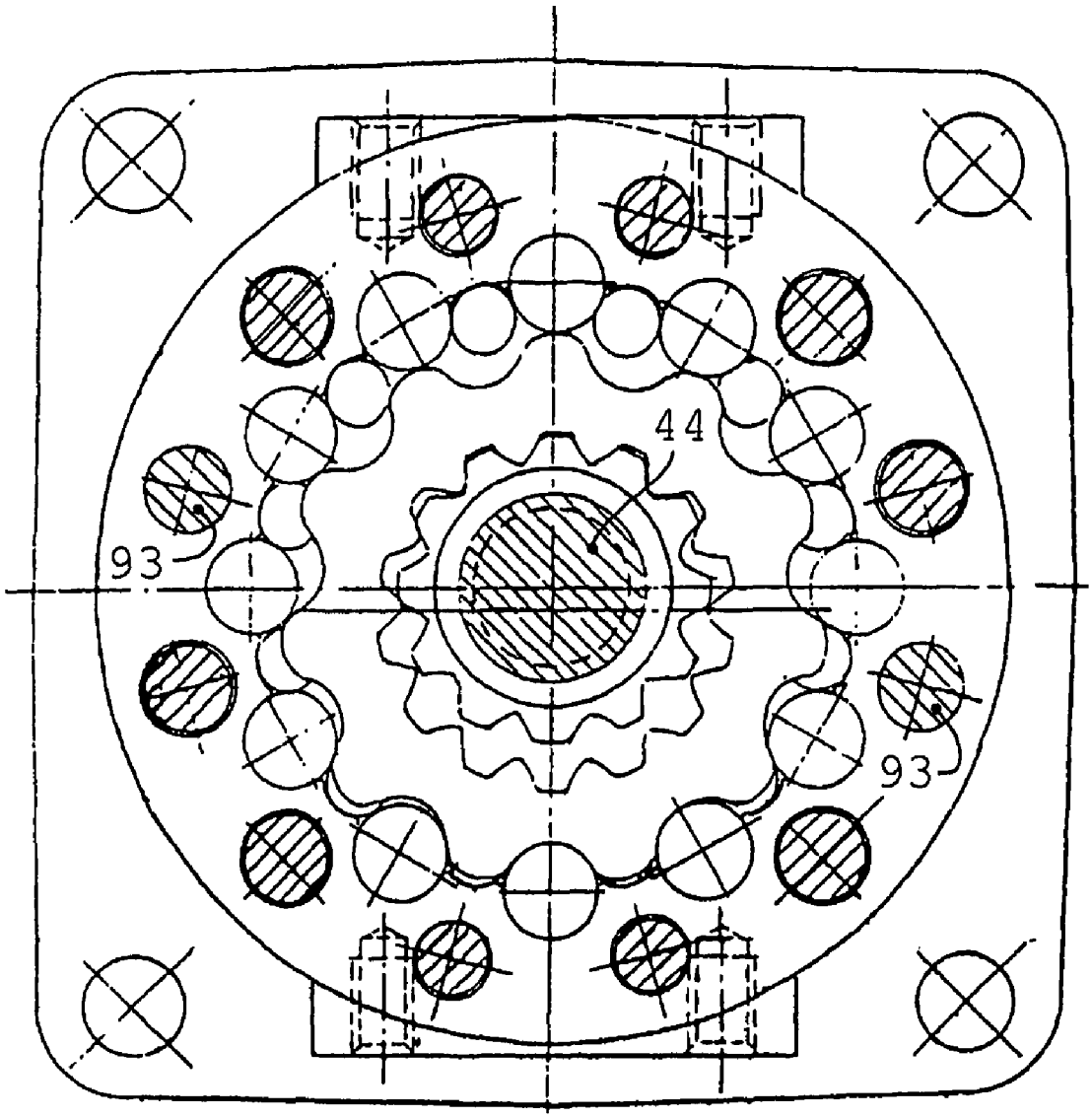
FIG. 8 shows a cross-section of the ⅔-stage engine along the section line E-E of FIG. 7.
Figure 9:
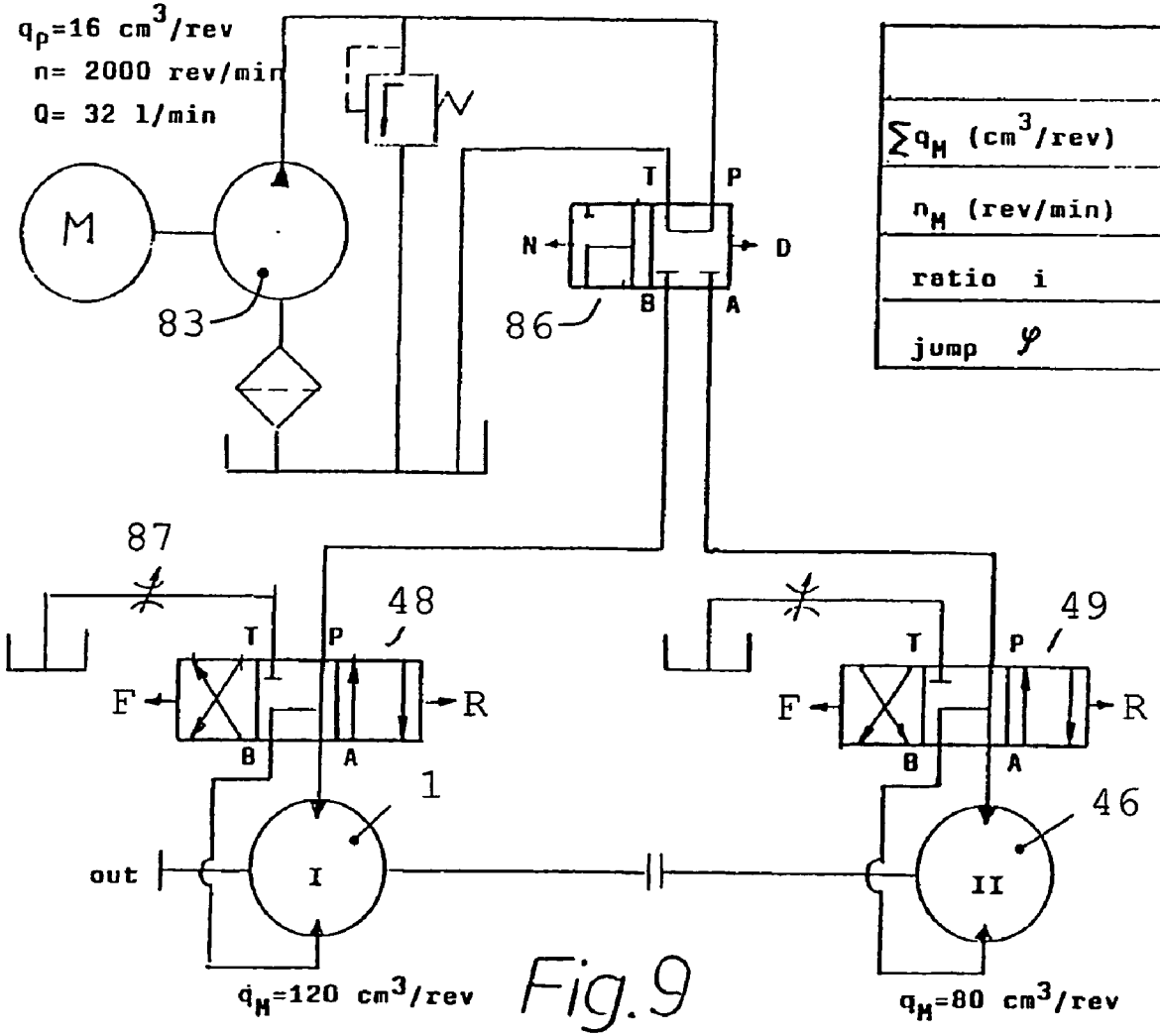
FIG. 9 shows a possible hydraulic circuit diagram for controlling the ⅔-stage engine according to FIG. 7 and FIG. 8 with exemplary technical data.

So-called "secondary regulation" is increasingly being demanded on the market, not only in the case of hydraulic wheel drives but increasingly also in the case of hydraulically driven cable winches. The aim here is to increase the speed range at the output without having to increase the delivery of the pump with respect to the discharge. The term "high-speed operation" is used here, which generally occurs at reduced torque requirement. FIG. 7 and FIG. 8 show a hydro motor in longitudinal section and cross-section, respectively, according to the invention, in which, in addition to the first power part 1, a second, preferably narrower power part 46 coupled non-rotatably to the first power part 1 and having its own radial bearing 47 is arranged on a lengthened shaft end 44 of the shaft 2, which second power part 46 can be operated separately with working fluid via the connections 75 and 76, preferably from one and the same hydraulic pump. A proposal concerning the control of such a ⅔-stage engine with the first power part 1 and the second power part 46 is shown in FIG. 9 in the form of a hydraulic circuit diagram with exemplary performance data. By means of two separate ¾-way valves 48 and 49 of commercial design, up to three output speeds can be operated therewith at the same delivery of a pump 83, as shown by way of example in table 77. The forward and reverse positions of the ¾-way valves are indicated by the letters F and R, respectively. Here, it should be noted that the engine stage which is switched to revolution and hence outputs no torque should be operated under high pressure both on the displacer side and especially on the intake side, since otherwise cavitation occurs in the case of high speeds on the intake side. With the regulation shown in FIG. 9, this situation is taken into account. A throttle valve serves as a brake valve 87, in particular when the vehicle is traveling downhill. By means of a valve 86, the operating state of the drive can be switched from drive D to neutral N.

Figure 10:
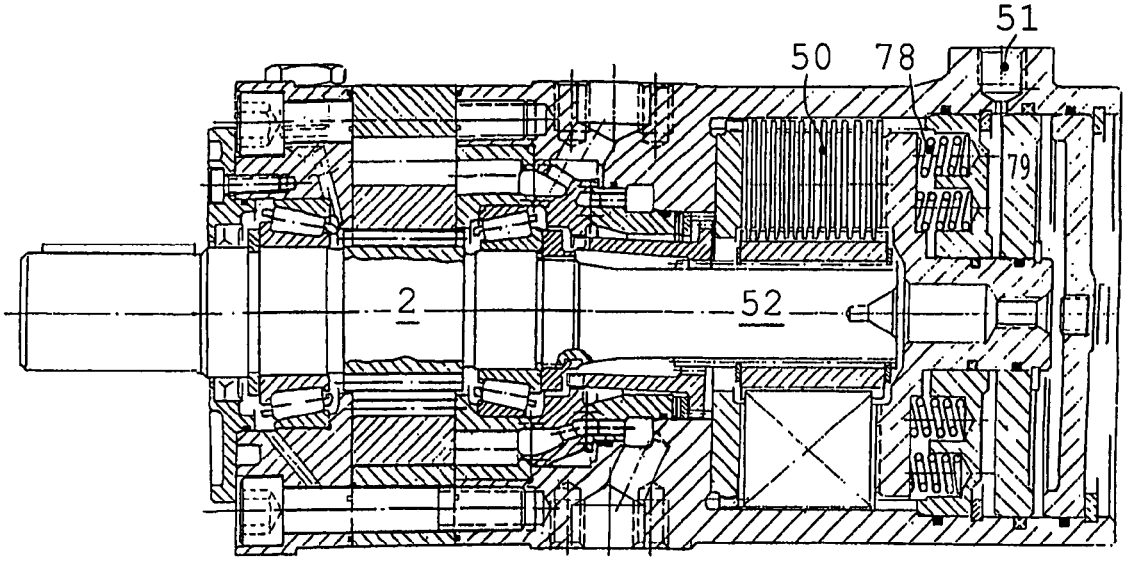
FIG. 10 shows a longitudinal section through a rotary cylinder engine according to the invention having a large-dimension working brake coupled to the shaft and in the form of a multiple disk brake.

FIG. 10 shows a further rotary cylinder engine according to the invention in longitudinal section, which can of course also be in the form of a wheel engine according to FIG. 5. In the embodiment, a hydraulically detachable spring-loaded working brake 50, in the form of a multiple disk brake, is arranged on a shaft extension 52. This working brake 50, whose braking force is applied by means of springs 78, has, for example in the case of a hydrostatically driven cable winch for truck-mounted cranes or ships' cranes, the task of keeping the full permissible cable load, which corresponds to the maximum high pressure and hence to the highest torque of the engine, in suspension without supporting hydraulic pressure at the engine. The load should be capable of being manipulated sensitively upward and downward so that the hydraulic oil feed at the rotary cylinder engine has to be switched from primary to secondary on changing from the upward to the downward movement and vice versa. In this phase of change, the rotary cylinder engine has no torque since the pressure drops to zero. At this moment, the spring-loaded working brake 50 assumes the holding moment and must therefore be designed to be so large that it can take up the maximum torque of the rotary cylinder engine. The size and number of springs 78 should be dimensioned accordingly, as should the size and number of disks of the working brake 50. As can be seen from FIG. 10, a high-pressure piston 79 which can be connected via a separate connection 51 to the high-pressure pump is provided, which high-pressure piston is capable of releasing the working brake 50 if the applied pressure on the high-pressure piston 79, by overcoming the spring forces of the spring 78, is sufficiently large. In practice, it has been found that this pressure must lie between 8 and 12 bar so that the load does not decrease until the required supporting pressure has been built up at the rotary cylinder engine.

There has already been a great deal of discussion as to whether such a large-dimensioned brake is expedient for a high-moment engine as is present in the case of the invention. The arrangement to date for such winch drives envisages that, instead of a rotary cylinder engine, an axial piston engine which is faster by a factor of 6 and drives the sun wheel of a planetary gear stage is used instead of a rotary cylinder engine. Its torque is accordingly smaller by a factor of 6. The multiple disk brake of the same design which is correspondingly likewise dimensioned to be smaller by a factor of 6 is then switched between the axial piston engine and the planetary stage, similar to the situation shown in FIG. 10. During operation of the winch, which also has to be operated at high speed in order to save time, this small brake runs relative to the housing, for example, at a speed 6 times that of the large brake according to the invention.

Wet-running multiple disk brakes have a particular advantage since they can be connected to the oil cooling system of the entire unit by the oil throughput. Moreover, they are substantially abrasion-free so that the oil contamination is low. A disadvantage is that, the case of the oil-filled brake, a considerable, oil viscosity-related, loss-producing slip results. According to the Newtonian sheer stress law in an oil gap, the slip between two plates increases as the square of the relative speed, and hence also between the running and stationary disks of a released brake. If it is assumed that, on comparison of the slips of a large brake according to FIG. 10 and a small brake described above, the oil viscosity, the thickness of the oil gap between the disks and the specific pressure on the disks due to the spring forces are identical, then, if the small disk brake runs 6 times faster, this slip is approximately 4 times as great as in the case of a low-speed large brake according to FIG. 10. It is therefore evident that—apart from the more economical solution—the compact version of a holding brake according to the invention together with the high-moment engine described here results in an improvement in the total efficiency of such a cable winch.

For the axial hydrostatic balance and a reduction of the axial running gaps to micron thickness between the control panel 22 and the rotary valve 3 on the one hand and between the rotary valve 3 and the axial compensating piston 65 on the other hand (cf. FIG. 1), very exact hydrostatically effective axial annular surfaces must be present. These are annular surfaces which are defined theoretically by the respective mean web diameter. They are not indicated particularly in FIGS. 1, 5, 6, 7 and 10. However, as can be seen there, the diameters of the connecting bores 58*a* in the axial compensating piston 65 and also the connecting bores in the rotary valve 3 are very small because the annular surface between the rotary valve 3 and the axial compensating piston 65 is theoretically relatively narrow. It is true that a very large number of such connecting bores 58*a* can be applied at the circumference in the axial compensating piston 65 so that the opening cross-section is relatively large. However, in the rotary valve 3, the number of connecting bores is very limited because they must depend on the number of high-pressure windows 21*a* of the rotary valve 3.

This gives rise to the problem that the flow rate is very high in these relatively small bores of the rotary valve 3. In hydraulics, the principle applies that at no point in a unit should the oil speed in the high-pressure range exceed from 10 to 12 m/s. Otherwise strong turbulence, low static pressure according to Bernouilli's equation and possibly cavitation damage on the channel walls result. Moreover, a disproportionate pressure drop which reduces the power and the efficiency of the engine occurs at these points at excessively high flow rates. Compared with known constructions, this disadvantage occurs because, in the embodiment according to the invention, the roller bearing on the right of the power part has a large external diameter. Thus, the system determines that the annular surface facing the rotary valve 3, with the pressure windows 33*a* of the control panel 22, is relatively narrow (smaller diameter difference of the sealing webs). Accordingly, the difference of the diameter of the counter-ring surface between the rotary valve 3 and the axial compensating piston 65 is then also smaller.

Figure 11:
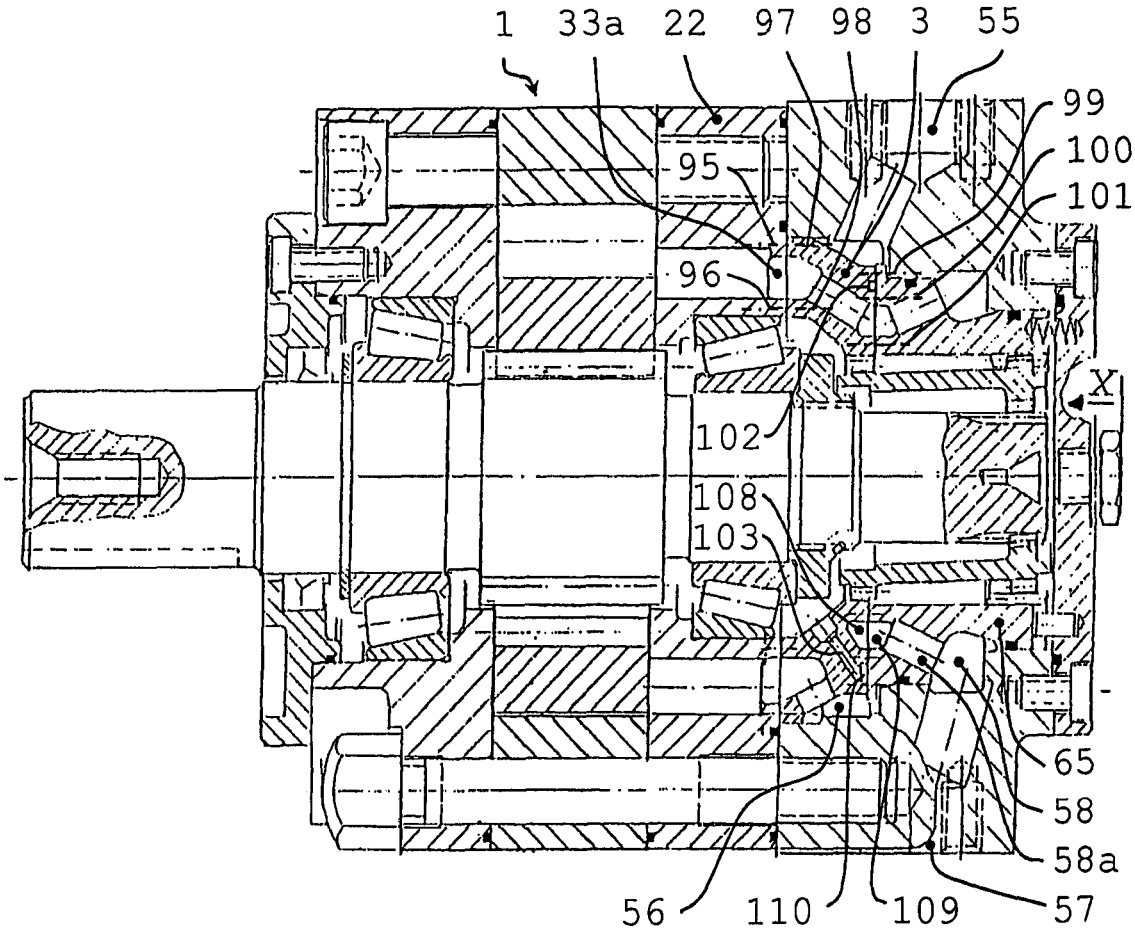
FIG. 11 shows a longitudinal section through an advantageous further development of a rotary cylinder engine according to the invention having an all-round axial relief groove in the axial sliding surface between rotary valve and compensating piston.

According to a further development of the invention, it is now proposed to change the counter-ring surface between the rotary valve 3 and the axial compensating piston 65 for the second annular space 58 to a smaller diameter range. If the high pressure for the reverse direction of rotation is passed into the second annular space 58, in this case too, the area content of the annular surface must be the same as before for the force balance. Thus, the diameter difference of the sealing webs will be considerably greater. In FIG. 11, which shows a longitudinal section through the advantageous further development of the rotary cylinder engine according to the invention, these conditions are clearly shown. Starting from the mean web diameter 95 and 96 of the control panel 22 (cf. FIGS. 11 and 12) and the corresponding mean web diameters 97 and 98 of the rotary valve 3 (cf. FIGS. 11, 13 and 14), which are shown by means of the dash-dot lines, the outer mean web diameter 99 between the rotary valve 3 and the axial compensating piston 65 (cf. FIGS. 11 and 13) initially remains the same because this, together with the web diameter 97, effects the force compensation at the rotary valve 3 when the high pressure is fed to the first annular space 56. In the other case where the high pressure is fed to the second annular space 58, the new annular surface located further inside the diameter is responsible for the axial balance of the rotary valve 3, which annular surface is determined by the new mean web diameters 100 and 101.

Figure 13:
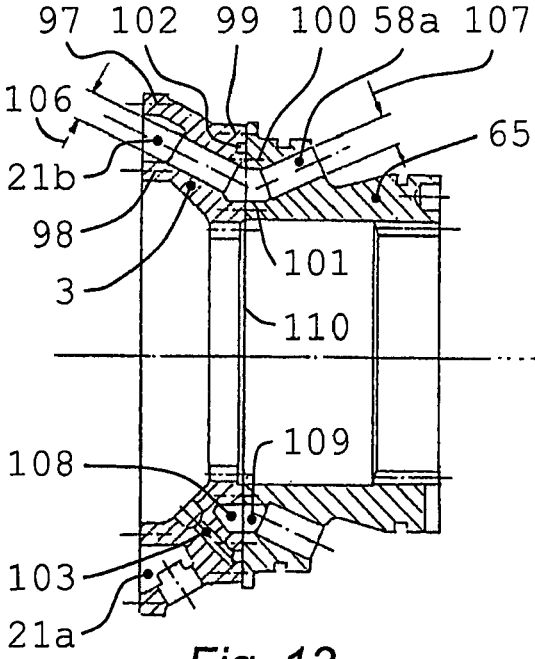
FIG. 13 shows a longitudinal section through the rotary valve and the compensating piston of the rotary cylinder engine from FIG. 11 in a detailed view and FIG. 14 shows a left view of the rotary valve and the compensating piston from FIG. 13.

The two annular surfaces acting to the left in FIGS. 11 and 13 on the rotary valve 3 with their respective hydrostatic compensating forces should now be completely separated from one another. This is effected according to the invention by an all-round axial relief groove 102 cut between the mean web diameters 99 and 100, as can be seen in FIGS. 11 and 13. The axial relief groove 102 running around the axial sliding surface 110 between the rotary valve 3 and the axial compensating piston 65 (cf. FIGS. 11 and 13) is thus located between the first annular space 56 surrounding the rotary valve 3 and connected to the high-pressure connection 55 and the annular grooves 108 and 109 of the further annular space 58 connected to the low-pressure connection 57.

In order for this relief groove 102 actually to be able to perform its separating function, it is connected to the leakage space 85 by the connecting bore 103. The relief groove 102 and its connecting bore 103 can be made both in the rotary valve 3 and in the axial compensating piston 65.

Figure 12:
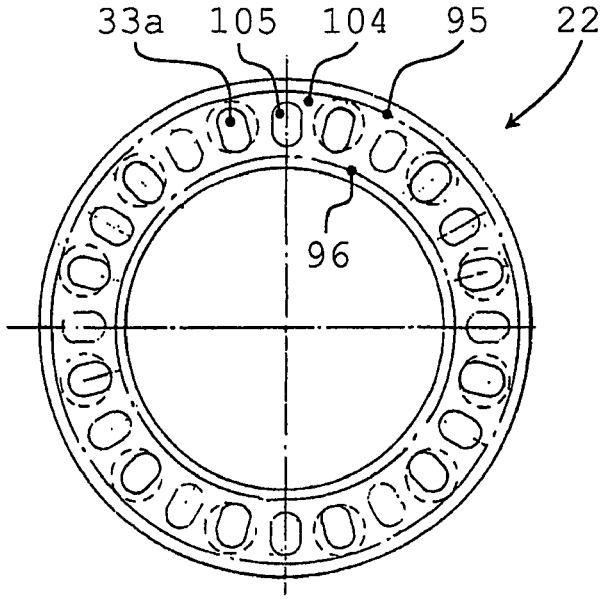
FIG. 12 shows a cross-sectional view of the valve plate of the control panel of the rotary cylinder engine from FIG. 11.
Figure 14:
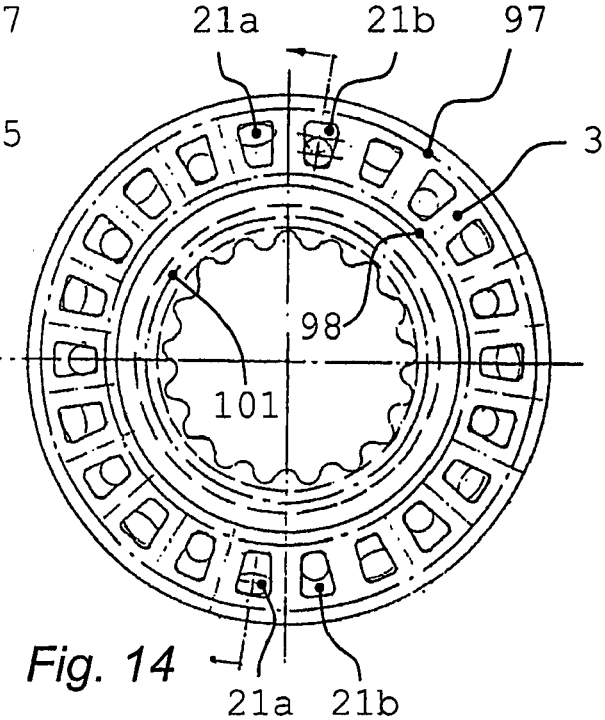

For a better understanding of the commutation function of the rotary valve 3, the required pressure windows 33*a* of the control panel 22 for supplying the tooth chambers of the power part 1 and the high-pressure and low-pressure windows 21*a* and 21*b*, respectively, in the rotary valve 3 are shown in FIGS. 12 and 14. The valve plate 104 of the control panel 22 (FIG. 12) has, between the pressure windows 33*a*, also identically dimensioned blind windows 105 which are only a few tenths of a millimeter deep for better isotropy of the lubricating film between the valve plate 104 and the rotary valve 3.

The advantages of this embodiment of the rotary cylinder engine according to the invention are considerable. A comparative investigation of the conditions according to FIGS. 1, 5, 6, 7 and 10 and the further developed embodiment according to FIGS. 11 to 14 has shown that the diameter 106 of the bores in the rotary valve 3 can be increased approximately by a factor of 7/5. Since this is the narrowest point in the flow system, this improvement means that the oil flow and hence the speed of the rotary cylinder engine can be approximately doubled at constant oil speed at this point. At the same time, the flow resistance is also reduced and hence the pressure drop, so that the efficiency increases. Since at the same time the diameter 107 of the connecting bore 58*a* in the axial compensating piston 65 also increases approximately in the same ratio, the flow loss is reduced there too and the number of required connecting bores 58*a* at the circumference of the axial compensating piston 65 can be smaller, resulting in lower manufacturing costs. Furthermore, the axial annual grooves 108 and 109 of the second annular space 58 (cf. FIGS. 11 and 13) are increased in cross-section, which also helps to reduce the flow losses. Altogether, this improvement means a considerable increase in power and a higher overall efficiency of the rotary cylinder engine.

It is of course possible to combine the further development of the invention shown in FIGS. 11 to 14 with features of previously described working examples and, for example, to equip a wheel engine or a winch drive with the last-described features constituting a further development.

The invention claimed is:

1. A hydrostatic, low-speed rotary cylinder engine, comprising:

a power part which acts as an output and comprises a central, stationary stator having a first inner tooth system with the number d of teeth, a rotary piston having a first outer tooth system partly engaging the first inner tooth system and having a number c of teeth and a second inner tooth system having a number b of teeth and a centrally mounted shaft having a second outer tooth system partly engaging the second inner tooth system and having a number a of teeth, the rotary piston, for executing an orbital movement, being arranged eccentrically and dimensioned so that tooth chambers which are supplied with working fluid and from which said fluid is discharged form between the first inner tooth system and the first outer tooth system, an inlet and outlet part for supplying working fluid to and discharging said fluid from the power part, a disk-like rotary valve for controlling the supply of the working fluid and discharge of the working fluid from the tooth chambers, an axial compensating piston for sealing to prevent leakage at the rotary valve, a toothed gear between an outer shaft tooth system of the shaft and a stationary inner toothed ring as synchronous drives of the rotary valve and two roller bearings arranged directly adjacent on the shaft on both sides of the power part, wherein the rotary valve is mounted so as to run concentrically with the shaft and with the stator, the toothed gear is arranged exclusively in a leakage oil region of the rotary cylinder engine and the toothed gear is in the form of a planetary gear having at least one planet carrier which is non-rotatably connected to the rotary valve and on which planet wheels are arranged between the outer shaft tooth system and the stationary inner toothed ring.

2. The hydrostatic, low-speed rotary cylinder engine as claimed in claim 1, wherein the first inner tooth system of the stator is formed by rotatably mounted rollers.

3. The hydrostatic, low-speed rotary cylinder engine as claimed in claim 1, wherein a spring-loaded parking brake which is hydraulically released via a separate connection is arranged on a shaft extension of the shaft on that side of the shaft which is opposite the output side of the shaft.

4. The hydrostatic, low-speed rotary cylinder engine as claimed in claim 1, wherein a spring-loaded working brake which is released via a separate connection by the operating pressure of the rotary cylinder engine is arranged on a shaft extension of the shaft on that side of the shaft which is opposite the output side of the shaft.

5. The hydrostatic, low-speed rotary cylinder engine as claimed in claim 1, wherein a second power part which is non-rotatably coupled to the first power part is arranged on a lengthened shaft end of the shaft on that side of the shaft which is opposite the output side of the shaft.

6. The hydrostatic, low-speed rotary cylinder engine as claimed in claim 5, wherein the specific intake of the second power part is designed to be substantially smaller than that of the first power part.

7. The hydrostatic, low-speed rotary cylinder engine as claimed in claim 5, wherein the first power part and the second power part are switchable by two separate 4/3-way valves.

8. The hydrostatic, low-speed rotary cylinder engine as claimed in claim 7, wherein the power part switched in each case to revolution is switchable under feed pressure both on the divergent and on the convergent side of the intake or displacer system.

9. The hydrostatic, low-speed rotary cylinder engine as claimed in claim 5, wherein the second power part which is non-rotatably coupled to the first power part has a separate radial bearing for the lengthened shaft end.

10. The hydrostatic, low-speed rotary cylinder engine as claimed in claim 1, wherein a wheel flange is arranged non-rotatably on the output side of the shaft for directly driving a wheel which is arranged on the wheel flange.

11. The hydrostatic, low-speed rotary cylinder engine as claimed in claim 10, wherein the output-side roller bearing of the two roller bearings arranged directly adjacent on the shaft on both sides of the power part is arranged outside a leakage space of the rotary cylinder engine with a permanent roller bearing grease fill, directly in the housing part of the rotary cylinder engine.

12. The hydrostatic, low-speed rotary cylinder engine as claimed in claim 10, wherein the wheel flange is formed integrally with the shaft.

13. The hydrostatic, low-speed rotary cylinder engine as claimed in claim 12, wherein the second power part which is non-rotatably coupled to the first power part has a separate radial bearing for the lengthened shaft end.

14. A hydrostatic, low-speed wheel engine, comprising a hydrostatic rotary cylinder engine as claimed in claim 10, a wheel which is driven directly by the hydrostatic rotary cylinder engine being arranged on the wheel flange.

15. A hydrostatic, low-speed winch drive, comprising a hydrostatic rotary cylinder engine as claimed in claim 10, a cable drum which is driven directly by the hydrostatic rotary cylinder engine being arranged on the wheel flange.

16. The hydrostatic, low-speed rotary cylinder engine as claimed in claim 1, wherein an all-round axial relief groove is provided on an axial sliding surface between the rotary valve and the axial compensating piston, which relief valve is located between a first annular space surrounding the rotary valve and connected to a high-pressure connection and annular grooves of a second annular space connected to a low-pressure connection.

17. The hydrostatic, low-speed rotary cylinder engine as claimed in claim 16, wherein the axial relief is connected by a connecting bore to a leakage space of the rotary cylinder engine.

18. The hydrostatic, low-speed rotary cylinder engine as claimed in claim 17, wherein the relief groove and the connecting bore thereof are arranged in the rotary valve.

19. The hydrostatic, low-speed rotary cylinder engine as claimed in claim 17, wherein the relief groove and the connecting bore thereof are arranged in the axial compensating piston.

20. The hydrostatic, low-speed rotary cylinder engine as claimed in claim 1, wherein the toothed gear between the outer shaft tooth system of the shaft and the stationary inner toothed ring as synchronous drives of the rotary valve is formed by a sun wheel.

21. A hydrostatic, low-speed rotary cylinder engine, comprising:

a power part which acts as an output and comprises a central, stationary stator having a first inner tooth system with the number d of teeth, a rotary piston having a first outer tooth system partly engaging the first inner tooth system and having a number c of teeth and a second inner tooth system having a number b of teeth and a centrally mounted shaft having a second outer tooth system partly engaging the second inner tooth system and having a number a of teeth, the rotary piston, for executing an orbital movement, being arranged eccentrically and dimensioned so that tooth chambers which are supplied with working fluid and from which said fluid is discharged form between the first inner tooth system and the first outer tooth system, an inlet and outlet part for supplying working fluid to and discharging said fluid from the power part, a disk-like rotary valve for controlling the supply of the working fluid and discharge of the working fluid from the tooth chambers, an axial compensating piston for sealing to prevent leakage at the rotary valve, a toothed gear between an outer shaft tooth system of the shaft having a number w of teeth and a fourth inner tooth system of a stationary inner toothed ring having a number z of teeth as synchronous drive for the rotary valve, and two roller bearings arranged directly adjacent on the shaft on both sides of the power part, wherein the rotary valve is mounted so as to run concentrically with the shaft and with the stator, the toothed gear is arranged exclusively in a leakage region of the engine and the toothed gear is in the form of an eccentric gear having an eccentric which is non-rotatably connected to the rotary valve.

22. The hydrostatic, low-speed rotary cylinder engine as claimed in claim 21, wherein the eccentric gear is in the form of a tumbling gear and the eccentric is in the form of a disk-like eccentric which is non-rotatably connected via a pot-like connecting part to the rotary valve via driver tooth systems in the speed ratio of 1:1.

23. The hydrostatic, low-speed rotary cylinder engine as claimed in claim 21, wherein the eccentric has a third inner tooth system with a number x of teeth and a third outer tooth system with a number y of teeth, is arranged between the outer shaft tooth system and the fourth inner tooth system and intermeshes with its third inner tooth system with the outer shaft tooth system of the shaft and with its third outer tooth system with the fourth inner tooth system of the stationary inner toothed ring.

24. The hydrostatic, low-speed rotary cylinder engine as claimed in claim 23, wherein the numbers of teeth of the power part and the numbers of teeth of the eccentric gear fulfill the equation $$\frac{\frac{b}{a}\cdot d - c}{d - c} = \frac{\frac{x}{w}\cdot z - y}{z - y}$$

and the result of this equation is a positive integer.

25. The hydrostatic, low-speed rotary cylinder engine as claimed in claim 24, wherein the positive integer is equal to 3.

26. The hydrostatic, low-speed rotary cylinder engine as claimed in claim 25, wherein the eccentric gear is designed in such a way that the ratio of the revolutions per minute Ne of the eccentricity of the eccentric gear to the number of revolutions Nw of the shaft according to the equation $$\frac{Ne}{Nw} = -\frac{w\cdot y}{x\cdot z - w\cdot y}$$

is from −3 to −9.

27. The hydrostatic, low-speed rotary cylinder engine as claimed in claim 24, wherein the number of teeth of the power part is a=12, b=14, c=11 and d=12 and the number of teeth of the eccentric gear is w=12, x=13, y=23 and z=24.

28. The hydrostatic, low-speed rotary cylinder engine as claimed in claim 24, wherein the number of teeth of the power part is a=12, b=14, c=11 and d=12 and the numbers of teeth of the eccentric gear is w=9, x=10, y=17 and z=18.

29. The hydrostatic, low-speed rotary cylinder engine as claimed in claim 21, wherein the common eccentricity of the eccentric gear is 0.013 to 0.015 times the mean reference circle diameter of control ports in a control panel.

30. The hydrostatic, low-speed rotary cylinder engine as claimed in claim 21, wherein the common eccentricity of the eccentric gear is 0.015 to 0.022 times the mean reference circle diameter of control ports in a control panel.

31. The hydrostatic, low-speed rotary cylinder engine as claimed in claim 21, wherein the number of teeth of the driver tooth systems between the eccentric and the rotary valve is twice as great as the number of teeth c of the first outer tooth system of the rotary piston of the power part.

32. The hydrostatic, low-speed rotary cylinder engine as claimed in claim 21, wherein the first inner tooth system of the stator is formed by rotatably mounted rollers.

33. The hydrostatic, low-speed rotary cylinder engine as claimed in claim 21, wherein a spring-loaded parking brake which is hydraulically released via a separate connection is arranged on a shaft extension of the shaft on that side of the shaft which is opposite the output side of the shaft.

34. The hydrostatic, low-speed rotary cylinder engine as claimed in claim 21, wherein a spring-loaded working brake which is released via a separate connection by the operating pressure of the rotary cylinder engine is arranged on a shaft extension of the shaft on that side of the shaft which is opposite the output side of the shaft.

35. The hydrostatic, low-speed rotary cylinder engine as claimed in claim 21, wherein a second power part which is non-rotatably coupled to the first power part is arranged on a lengthened shaft end of the shaft on that side of the shaft which is opposite the output side of the shaft.

36. The hydrostatic, low-speed rotary cylinder engine as claimed in claim 21, wherein a wheel flange is arranged non-rotatably on the output side of the shaft for directly driving a wheel which is arranged on the wheel flange.

37. The hydrostatic, low-speed rotary cylinder engine as claimed in claim 21, wherein an all-round axial relief groove is provided on an axial sliding surface between the rotary valve and the axial compensating piston, which relief valve is located between a first annular space surrounding the rotary valve and connected to a high-pressure connection and annular grooves of a second annular space connected to a low-pressure connection.

38. The hydrostatic, low-speed rotary cylinder engine as claimed in claim 21, wherein the toothed gear between the outer shaft tooth system of the shaft having a number w of teeth and the fourth inner tooth system of the stationary inner toothed ring having a number z of teeth as synchronous drive for the rotary valve is formed by a sun wheel.

* * * * *